United States Patent [19]

Fukano et al.

[11] Patent Number: 5,049,945

[45] Date of Patent: Sep. 17, 1991

[54] IMAGE FORMING APPARATUS WITH A SIMPLIFIED PAPER UNJAMMING MECHANISM

[75] Inventors: Masahiko Fukano, Osaka; Akihiro Kondo, Sakai, both of Japan

[73] Assignee: Mita Industrial Co., Ltd., Osaka, Japan

[21] Appl. No.: 483,369

[22] Filed: Feb. 22, 1990

[30] Foreign Application Priority Data

Feb. 23, 1989 [JP] Japan ..... 1-21255
Feb. 23, 1989 [JP] Japan ..... 1-44344

[51] Int. Cl.[5] ..... G03G 15/20

[52] U.S. Cl. ..... 355/290; 219/216; 355/285

[58] Field of Search ..... 355/290, 289, 285, 282; 219/216, 469, 470

[56] References Cited

U.S. PATENT DOCUMENTS 4,428,660 1/1984 Matsumoto ..... 355/290
4,598,990 7/1986 Kusumoto et al. ..... 355/290
4,696,561 9/1987 Katoh et al. ..... 355/295

OTHER PUBLICATIONS

M. L. Steinbrecher, "Fuser Latch for Copiers", IBM Technical Disclosure Bulletin, 3/82, vol. 24, No. 10.

*Primary Examiner*—A. T. Grimley
*Assistant Examiner*—Thu Dang
*Attorney, Agent, or Firm*—Beveridge, DeGrandi & Weilacher

[57] ABSTRACT

The present invention provides an image forming apparatus which includes a rotating unit for slightly rotating an upper unit. The upper unit is provided with a heating member and is located in the image fixing unit. The upper unit is rotatably mounted on a lower unit which is provided with a pressure member in the image fixing unit to release the contact of the heating member with the pressure member. This image forming apparatus can easily and safely remove a jammed paper sheet from the image fixing unit.

11 Claims, 10 Drawing Sheets

FIG.10a
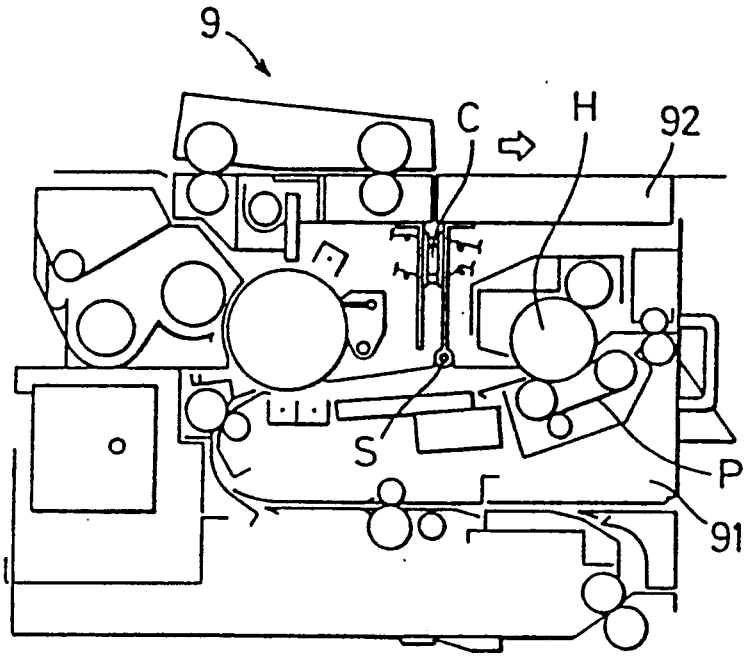
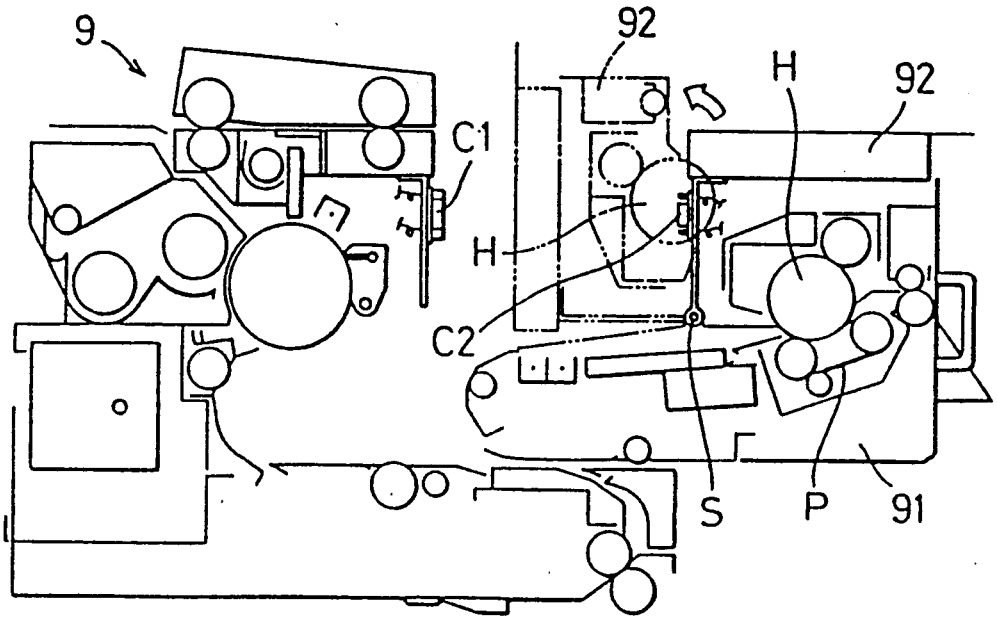
FIG.10b

IMAGE FORMING APPARATUS WITH A SIMPLIFIED PAPER UNJAMMING MECHANISM

BACKGROUND OF THE INVENTION

1. Field of the Invention

The present invention relates generally to image forming apparatuses, and more particularly, to an image forming apparatus comprising fixing means for fixing a toner image transferred to a paper sheet by inserting the paper sheet between a heating member heated to a predetermined temperature and a pressure member brought into contact with the heating member.

2. Description of the Prior Art

Image forming apparatuses comprising the above described fixing means, such as an electrophotographic copying machine; a printer and a facsimile which have been heretofore proposed include various ones, for example, one adapted such that fixing means can be pulled out of its main body and one adapted such that a heating member and a pressure member which are in contact with each other can be separated from each other so as to simplify the removal of a jammed paper sheet when a paper jam occurs inside of the fixing means.

In the above described image forming apparatus, a main portion of the fixing means comprises a pressure belt P serving as the pressure member and a heating roller H serving as the heating member, as shown in FIG. 10 (*a*). The pressure belt P is provided in a lower unit 91 which can be pulled out of the main body 9 of the apparatus, and the heating roller H is provided in an upper unit 92 connected to the lower unit 91 rotatably around a supporting shaft S. When a paper jam occurs, both the units 91 and 92 are pulled out of the apparatus as shown in FIG. 10 (*b*) and then, the upper unit 92 is rotated around the supporting shaft S as represented by an arrow in FIG. 10 (*b*), to separate the heating roller H from the pressure belt P. Consequently, a jammed paper sheet can be easily and quickly removed.

However, the above described image forming apparatus has the following problems.

(1) In order to safely remove a jammed paper sheet, the upper unit 92 must be rotated to the utmost as represented by a two dots and dash line in FIG. 10 (*b*) not to fall. Consequently, the heating roller H is exposed over a wide range. Accordingly, an operator is liable to get burnt in the hand by touching the above heating roller H with the hand while removing a jammed paper sheet.

(2) In the above described state where the upper unit 92 is rotated to the utmost, a portion of the paper conveying path which is on the upstream side in the paper-delivery direction of the fixing means disposed on the paper conveying path is covered with the upper unit 92. Accordingly, it is difficult to perform the work of pulling out a jammed paper sheet to the upstream side of the fixing means.

(3) The upper unit 92 is generally rotated manually. Accordingly, if an operator roughly performs such a rotating operation or erroneously lets go his hold of the upper unit 92 during the rotating operation, this upper unit 92 is rapidly rotated upward or downward to violently collide with the main body 9 of the apparatus or the lower unit 91, resulting in the possibility of adversely affecting an internal mechanism or the like in the apparatus.

Furthermore, in the above described image forming apparatus, if the connection between the upper unit 92 and the lower unit 91 is imperfect in inserting the lower unit 91 into the main body 9 of the apparatus after the jammed paper sheet is removed, parts mounted on the main body 9 of the apparatus and the upper unit 92, for example, a connector C comprising a socket C1 and a plug C2 for supplying power from the main body 9 of the apparatus to the heating roller H and transmitting a signal from a thermistor, a heater or the like provided inside of the unit to the main body 9 of the apparatus are liable to be damaged.

The foregoing may be, in many cases, problems particularly in a case of a large-sized image forming apparatus capable of using large-sized paper sheets of the A0 size and the like for the following reasons. More specifically, the larger the paper sheets are, the wider the heating member must be. Accordingly, the upper unit becomes large and heavy, thereby making it difficult to manually rotate the upper unit and hold the same during the rotation. In addition, the upper unit becomes wide, so that the upper unit is liable to be twisted on the right and left sides thereof. Furthermore, locking of the upper unit on either one of the right and left sides thereof becomes imperfect, thereby increasing the possibility that the upper unit is separated from the lower unit.

SUMMARY OF THE INVENTION

A primary object of the present invention is to provide an image forming apparatus capable of easily and safely removing a jammed paper sheet in fixing means.

Another object of the present invention is to provide an image forming apparatus capable of safely and reliably inserting into the main body of the apparatus fixing means after removing a jammed paper sheet.

The present invention provides an image forming apparatus which comprises fixing means comprising a heating member and a pressure member brought into contact with the heating member for fixing a toner image transferred to the surface of a paper sheet by inserting the paper sheet therebetween, a lower unit provided such that it can be pulled out from the main body of the apparatus for holding the pressure member in the above fixing means, an upper unit rotatably mounted on the above lower unit for holding the heating member in the fixing means, locking means for preventing the rotation of the upper unit so as to maintain a state where the above heating member and the above pressure member are in contact with each other, and rotating means for slightly rotating the upper unit with the prevention of the rotation of the upper unit by the above locking means being released to release the contact of the heating member with the pressure member.

The above described rotating means may use one including a guide shaft turnably supported with the lower unit at one end portion thereof so as to turn around the one end portion, a slider slidably fitted on the guide shaft and detachably engaged with the upper unit, and a coil spring arranged between the one end portion of the guide shaft and the slider for pressing the slider in such a direction as to be separated from the one end portion of the guide shaft.

In accordance with another aspect, the present invention provides an image forming apparatus, wherein the main body of the apparatus and the upper unit are provided with an engaging portion and a portion to be engaged which are engaged with each other when the lower unit is inserted into the main body of the apparatus with the upper unit not being rotated to the position where it is to be locked by the locking means, to prevent the lower unit from being inserted into the main body of the apparatus.

In accordance with still another aspect, the present invention provides an image forming apparatus, wherein the main body of the apparatus and the upper unit are provided with an engaging portion and a portion to be engaged which are engaged with each other when the lower unit is inserted into the main body of the apparatus with the upper unit not being rotated to the position where it is to be locked by the locking means, to rotate the upper unit to the position where it is to be locked.

Projections provided in the upper unit may be used as the above described engaging portion, and an inclined portion formed in a side plate, of the main body of the apparatus, provided along a moving path of the lower unit for moving the above projections downward as the lower unit is inserted into the main body of the apparatus to rotate the upper unit to the position where it is to be locked may be used as the above described portion to be engaged.

In the image forming apparatus according to the present invention, when the prevention of the rotation of the upper unit by the locking means is released in removing a jammed paper sheet in the fixing means, the upper unit is slightly rotated by the function of the rotating means. Accordingly, the contact of the heating member with the pressure member is released, thereby making it possible to remove the jammed paper sheet without manually rotating the upper unit. Accordingly, all the above described problems (1) to (3) encountered when the upper unit is manually rotated can be solved. Consequently, the image forming apparatus according to the present invention can easily, safely and reliably remove the jammed paper sheet in the fixing means.

In a case where the above described rotating means includes a guide shaft turnably supported with the lower unit at one end portion thereof so as to turn around the one end portion, a slider slidably fitted on the guide shaft and detachably engaged with the upper unit, and a coil spring arranged between the one end portion of the guide shaft and the slider for pressing the slider in such a direction as to be separated from the one end portion of the guide shaft, when the engagement of the slider with the upper unit is released, the upper unit can be rotated to the utmost. Accordingly, the image forming apparatus according to the present invention has the merit of being able to easily carry out maintenance of the parts in the upper and lower units.

In accordance with a further aspect of the present invention, if the upper unit is not rotated to the position where it is to be locked by the locking means, the lower unit can be prevented from being inserted into the main body of the apparatus by the engagement of the engaging portion with the portion to be engaged. In accordance with a still further aspect, the upper unit can be rotated to the position where it is to be locked by the engagement of the engaging portion with the portion to be engaged. Accordingly, in either case, the fixing means after removing a jammed paper sheet can be safely and reliable inserted into the main body of the apparatus.

Meanwhile, in a case where the projections provided in the upper unit are used as the above described engaging portion and the inclined portion formed in the side plate, of the main body of the apparatus, provided along the moving path of the lower unit for moving the above projections downward as the lower unit is inserted into the main body of the apparatus to rotate the upper unit to the position where it is to be locked is used as the portion to be engaged, the image forming apparatus according to the present invention has the merit of simplifying the structure thereof.

BRIEF DESCRIPTION OF THE DRAWINGS

FIG. 6 (*b*) is a schematic diagram for explaining the functions of an engaging portion and a portion to be engaged in the embodiment shown in FIG. 5;

FIGS. 10 (*a*) and (*b*) are schematic diagrams showing states before and after a unit in a conventional image forming apparatus is pulled out.

DESCRIPTION OF THE PREFERRED EMBODIMENTS

Figure 9:
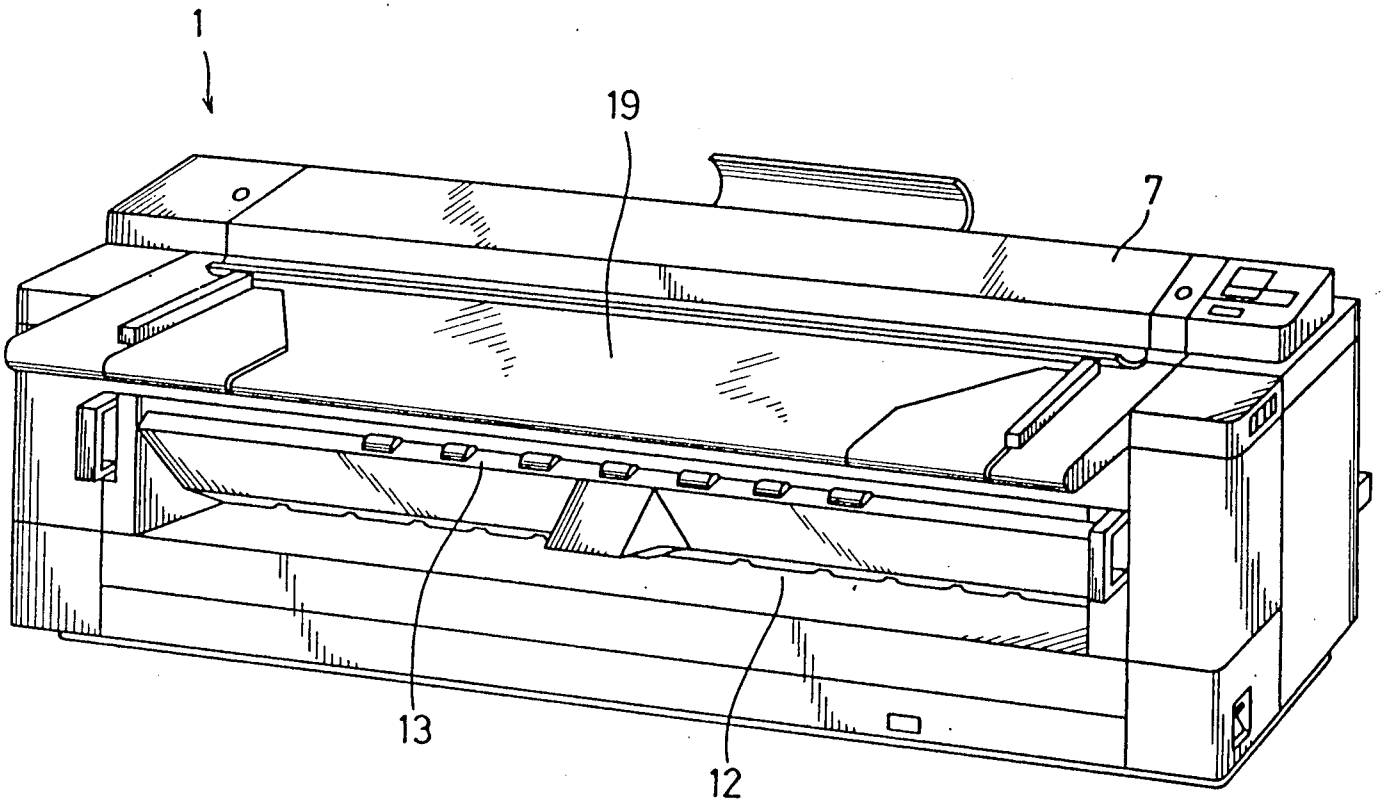
FIG. 9 is a perspective view showing the appearance of the image forming apparatus according to the present embodiment.

FIG. 9 is a diagram showing the appearance of an electrophotographic copying apparatus as an embodiment of an image forming apparatus according to the present invention. This electrophotographic copying apparatus is a large-sized one comprising a wide paper feed portion 12 and a wide paper delivery portion 13 on the front surface of an oblong main body 1 of the apparatus as well as wide original conveying means 7 on the upper surface thereof and suitable for reproduction on large-sized paper sheets.

Figure 7:
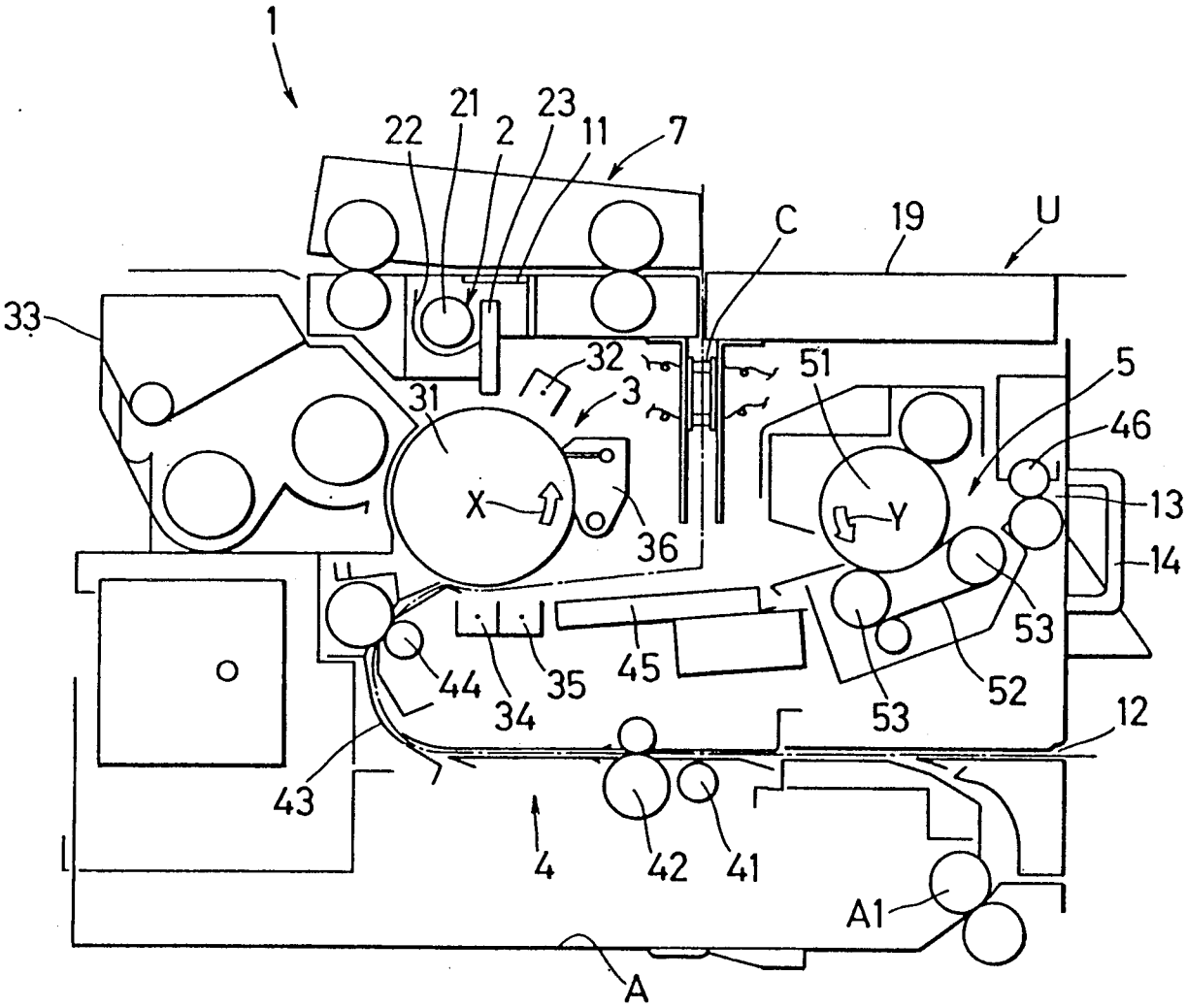
FIG. 7 is a schematic diagram showing an internal structure of an image forming apparatus according to the present embodiment.

FIG. 7 is a schematic diagram showing the internal construction of the above described electrophotographic copying apparatus. In this electrophotographic copying apparatus, an optical system 2 for scanning and exposing an original is provided in the upper part of the main body 1 of the apparatus, an image forming section 3 for forming a reproduced image to transfer the same to a paper sheet (not shown) is provided below the optical system 2, and a paper conveying section 4 is provided from below the above image forming section 3 to the upper right of FIG. 7 and fixing means 5 for fixing a toner image transferred to the paper sheet is provided in a halfway portion on the downstream side in the paper-delivery direction of the paper conveying section 4.

The above described optical system 2 comprises a light source 21, a concave reflector 22, an optical element 23 and the like. This optical system 2 is capable of exposing and scanning an original document which is traveled on a transparent platen 11 by the original conveying means 7. The original document is fed into the original conveying means 7 from an original inserting tray 19 on the upper surface of the main body 1 of the apparatus.

The image forming section 3 has a charging corona discharger 32, a developing device 33, a transferring corona discharger 34, a separating corona discharger 35, and a cleaner 36 in this order around a photosensitive drum 31 rotating in the direction represented by an arrow X in FIG. 7. In this image forming section 3, an image of the original document is formed by the above optical system 2 on the surface of the photosensitive drum 31 uniformly charged by the charging corona discharger 32 to form an electrostatic latent image and then, the electrostatic latent image is developed into a toner image by the developing device 33, the toner image is transferred to a paper sheet by the transferring corona discharger 34, the paper sheet is separated from the photosensitive drum 31 by the separating corona discharger 35 and then, residual toner can be recovered by the cleaner 36.

The paper conveying section 4 has a paper feeding roller 41, a registration roller 42, a paper guide plate 43, a conveying roller 44, a paper guide plate 45, and a delivery roller 46 in this order from the innermost part of the paper feed portion 12 from the paper delivery portion 13. In this paper conveying section 4, a paper sheet supplied from a paper feeding cassette A arranged in the lower part of the main body 1 of the apparatus or the paper feed portion 12 is introduced into the image forming section 3 by driving the paper feeding roller 41 to transfer a toner image on the paper sheet, the toner image is heated and fixed by the fixing means 5 and then, the paper sheet is carried out of the apparatus from the paper delivery portion 13. A paper feeding roller A1 for taking out paper sheets contained in the paper feeding cassette A one at a time to feed the same is provided in the front end of the above paper feeding cassette A.

In the fixing means 5, a heating roller 51 serving as a heating member is arranged with it being brought into contact with a pressure belt 52 serving as a pressure member. This fixing means 5 can fix the toner image by conveying to the paper-delivery side the paper sheet on which the toner image is transferred with it being interposed between the above heating roller 51 and the above pressure belt 52. The above heating roller 51 is always rotated in the direction represented by an arrow Y in FIG. 7 with it being heated to a predetermined temperature by heating means such as a heater provided inside thereof while the electrophotographic copying apparatus is operated. On the other hand, the pressure belt 52 is brought into contact with the heating roller 51 with it being wound around a pair of cylindrical or barrel-shaped drums 53 which are provided spaced apart from each other at a predetermined interval and is rotated as the heating roller 51 is rotated.

Figure 8:
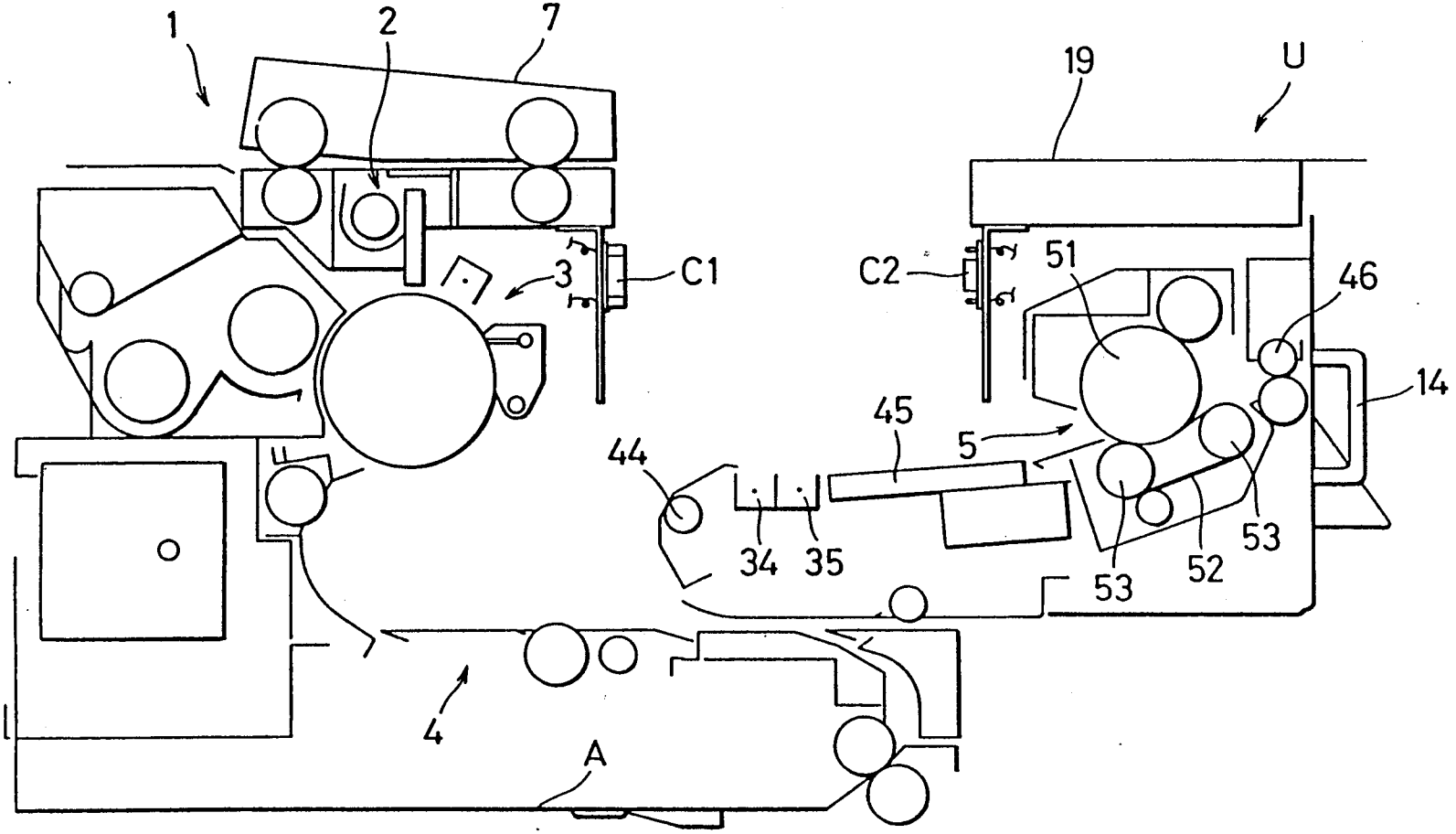
FIG. 8 is a schematic diagram showing a state where a unit including fixing means is pulled out of the above image forming apparatus.

The above described fixing means 5, along with the transferring corona discharger 34 and the separating corona discharger 35 in the image forming section 3, the conveying roller 44, the paper guide plate 45 and the delivery roller 46 in the paper conveying section 4, and the like, is arranged in a unit U provided such that it can be pulled out of the main body 1 of the apparatus (a portion divided from the main body 1 of the apparatus by a dot and dash line in FIG. 7). The above unit U is pulled out of the main body 1 of the apparatus by pulling out the same to the right of FIG. 7 by a handle 14 on its front surface (see FIG. 8). In addition, a connector C comprising a socket C1 and a plug C2 for supplying power from the main body 1 of the apparatus to the heating means provided inside of the above heating roller 51 and transmitting to the main body 1 of the apparatus a signal from a thermistor, heating means or the like provided in the unit U is provided on the surfaces, which are opposed to each other, of the above unit U and the main body 1 of the apparatus.

Figure 1:
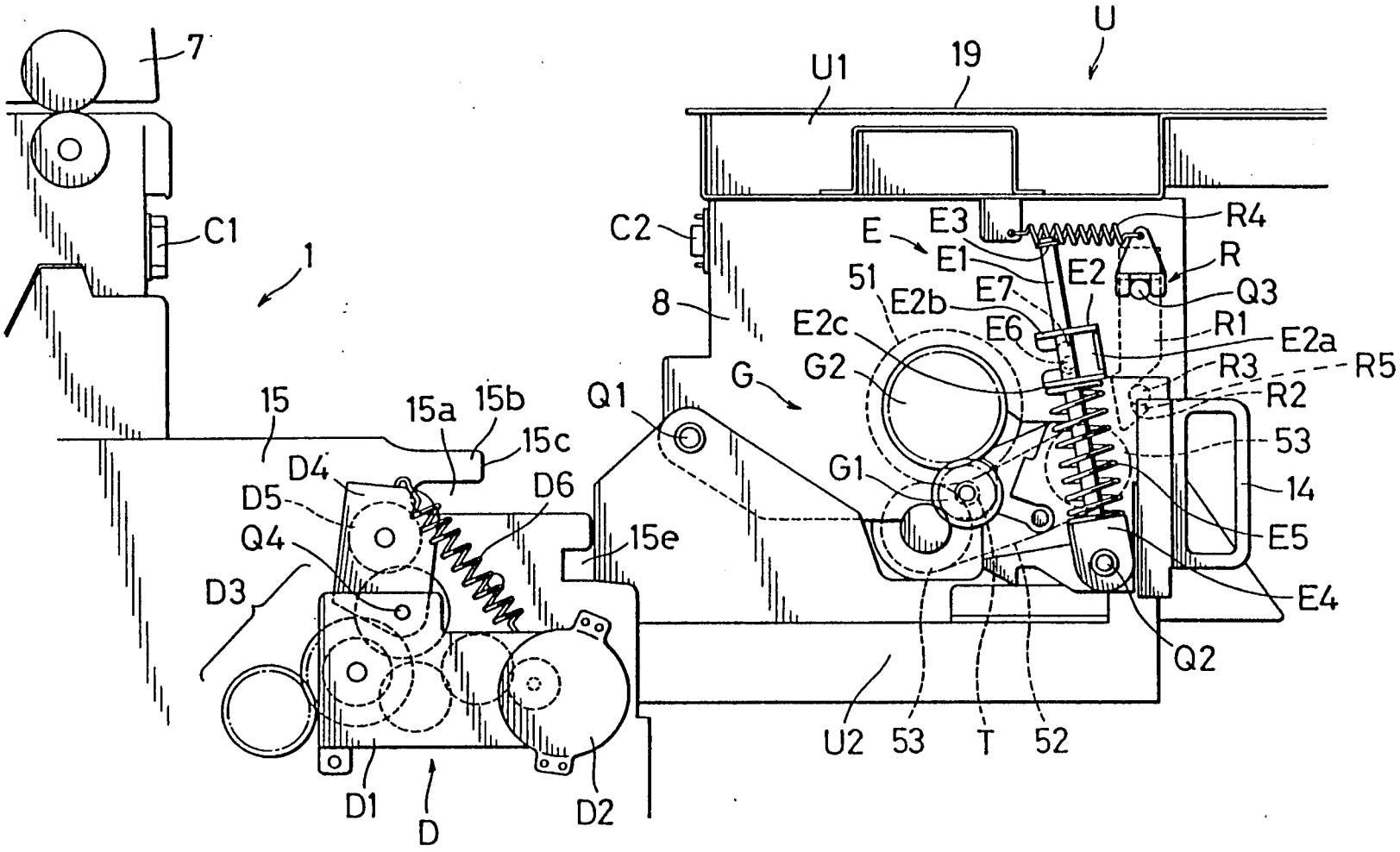
FIG. 1 is a front view showing a state where both upper and lower units of an image forming apparatus according to the present invention are pulled out from the main body of the apparatus.

The unit U is composed of an upper unit U1 comprising the heating roller 51 and a lower unit U2 comprising the pressure belt 52 and the like, as shown in FIG. 1. The lower unit U2 is slidably supported by a slide rail (not shown) in the main body 1 of the apparatus such that it can be pulled out of the main body 1 of the apparatus. In addition, the upper unit U1 is attached to the lower unit U2 rotatably around a supporting shaft Q1 and the rotation thereof is prevented by two sets of locking means R (only one set on this side is illustrated in FIGS. 1 to 4) provided on the right and left sides, in FIG. 9, of the upper unit U1. The heating roller 51 can be brought into contact with the pressure belt 52 in this state where the rotation of the upper unit U1 is prevented.

The locking means R comprises a locking plate R1 supported by side plates 8 on both sides of the upper unit U1 (only one side plate on this side is illustrated in FIGS. 1 to 4) rotatably around a supporting shaft Q3, an engaging pin R3 which is provided in the lower unit U2 and engaged with an engaging concave portion R2 formed in the above locking plate R1, and a spring member R4 for pressing the locking plate R1 in the direction of the engaging pin R3.

There are provided on both sides of the unit U two sets of rotating means E (only one set on this side is illustrated in FIGS. 1 to 4) for slightly rotating the upper unit U1 when the prevention of the rotation of the upper unit U1 by the above locking means R is released, to release the contact of the heating roller 51 with the pressure belt 52. This rotating means E comprises a guide shaft E1 turnably supported with the lower unit U2 at one end portion E4, a slider E2 slidably fitted on this guide shaft E1 and detachably engaged with the upper unit U1, and a coil spring E5 arranged between the one end portion E4 of the guide shaft E1 and the slider E2 for pressing the slider E2 in such a direction as to be separated from the one end portion E4 of the guide shaft E1.

The guide shaft E1 extends in the opposite direction to a supporting shaft Q2 from the one end portion E4 supported turnably around the supporting shaft Q2 which is attached to the side surface of the lower unit U2. A stopper E3 for regulating the slide of the slider E2 is attached to the another end portion of the guide shaft E1.

The slider E2 is made of a single plate material and comprises a main body E2*a* arranged in parallel with an axis of the above guide shaft E1 and a pair of folded portions E2*b* and E2*c* formed by folding the upper and lower parts of the main body E2*a* and perpendicular intersecting the axis of the guide shaft E1. This slider E2 is slidably fitted on the above guide shaft E1 by inserting the guide shaft E1 into through-holes (not shown) provided in the folded portions E2*b* and E2*c*. In addition, the main body E2*a* of the above slider E2 is provided with an engaging concave portion E7 which is detachably engaged with an engaging pin E6 formed so as to be projected outward from the side plates 8 on both sides of the upper unit U1.

The coil spring E5 is formed such that the inside diameter of a coil is larger than the outside diameter of the guide shaft E1. This coil spring E5 is arranged between the one end portion E4 of the above guide shaft E1 and the slider E2 with the guide shaft E1 being inserted into the coil spring E5. The above coil spring E5 is compressed between the slider E2 and the base portion E4 when the rotation of the upper unit U1 is prevented by the locking means R, to press the slider E2 in such a direction as to be separated from the one end portion E4.

In a case where in the above unit U, a paper jam occurs with the paper sheet being interposed between the heating roller 51 and the pressure belt 52, when the privention of the rotation of the upper unit U1 by the locking means R is released by operating a locking release lever (not shown), the slider E2 is pushed up to the vicinity of the stopper E3 by the pressure of the coil spring E5 in the rotating means E. Then, the upper unit U1 connected to the above slider E2 is rotated upward around the supporting shaft Q1 by the engagement of the slider E2 with the engaging pin E6. Consequently, the heating roller 51 provided in this upper unit U1 is separated from the pressure belt 52 provided in the lower unit U2, thereby allowing a jammed paper sheet to be removed (see FIG. 2).

After the removal of the jammed paper sheet is completed, when the upper unit U1 is rotated downward against the pressure of the coil spring E5, the above engaging pin R3 is engaged with the engaging concave portion R2 beyond a projection R5 in the end of the locking plate R1. Accordingly, the upper unit U1 is locked, returning again to a state where the heating roller 51 is brought into contact with the pressure belt 52.

Two projections T (only one projection on this side is illustrated in FIGS. 1 to 4) serving as an engaging portion for preventing the lower unit U2 from being inserted into the main body 1 of the apparatus if the upper unit U1 is not rotated to the position where it is to be locked by the locking means R are formed on both sides of the upper unit U1. A state where the upper unit U1 is not rotated to the position where it is to be locked by the locking means R means, for example, a state where locking by either one of a pair of locking means R is imperfect and one side of the upper unit U1 where locking is imperfect is lifted by the pressure of the rotating means E, to be separated from the lower unit U2. The above projections T are engaged with a stopper surface 15*c* serving as a portion to be engaged as described below, to prevent the lower unit U2 from being inserted into the main body 1 of the apparatus. The projections T are formed to be projected outward from the surface of the side plates 8 on both sides of the upper unit U1. In this embodiment, the above projections T also serve as a supporting shaft of a gear G1.

On the other hand, in the main body 1 of the apparatus, two concave portions 15*a* and 15*e* and a convex portion 15*b* are respectively formed in the positions corresponding to the projections T on both sides of the upper unit U1. They are formed by processing in an irregular shape an upper end (upper right end in FIG. 1) of a pair of side plates 15 (only one on this side is illustrated in FIG. 1) provided along a moving path of the lower unit U2. An end surface of the above convex portion 15*b* is constructed as the stopper surface 15*c* to which the above projections T are applied. The above projections T may be applied to this stopper surface 15*c* when the lower unit U2 is inserted into the main body 1 of the apparatus in not only a state where locking of the upper unit U1 by the locking means R is imperfect but also a state where the upper unit U1 is slightly rotated by the rotating means E.

Figure 3:
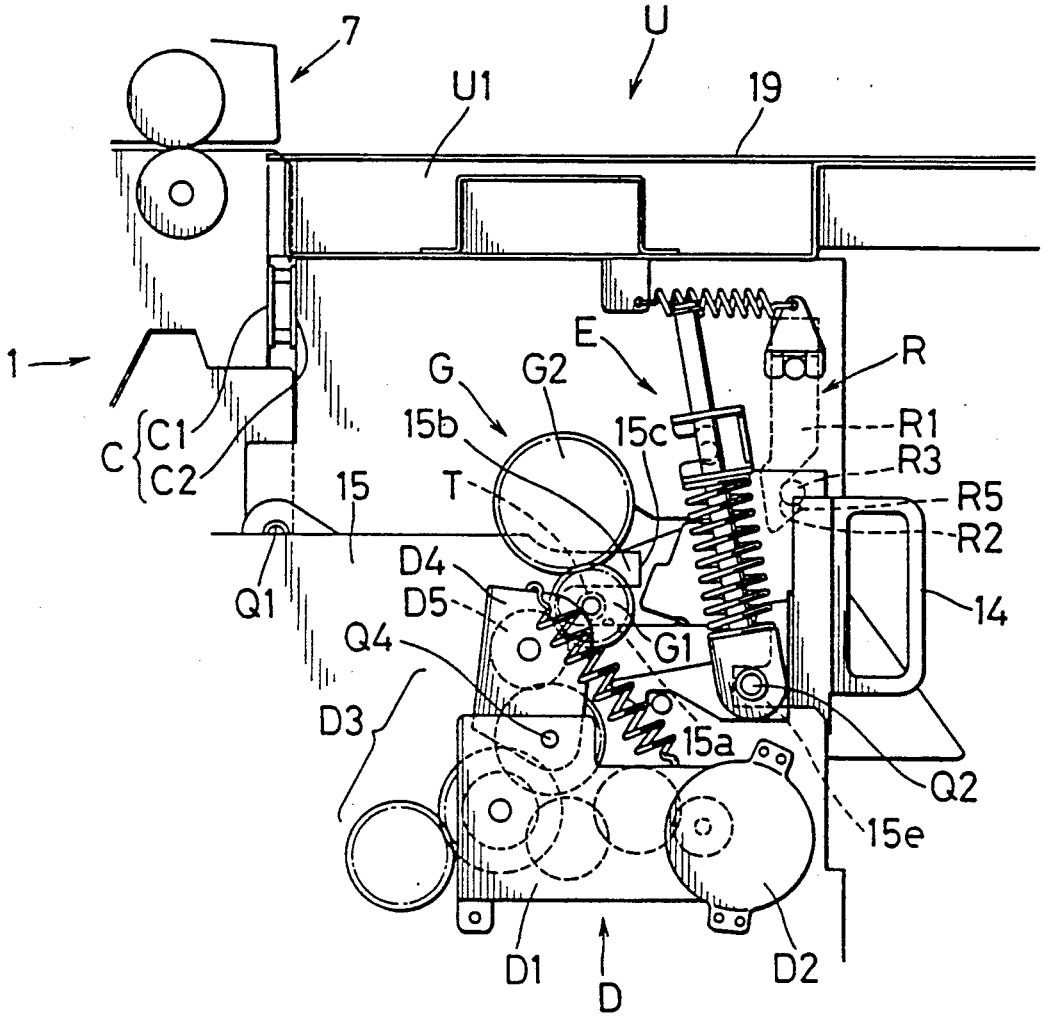
FIG. 3 is a front view showing a state where the upper and lower units with a heating member and a presure member being in contact with each other are inserted into the main body of the apparatus.

The projections T are introduced into the concave portion 15*a* if the upper unit U1 is completely locked by the locking means R, to allow the lower unit U2 to be inserted into the main body 1 of the apparatus. The concave portion 15*e* regulates the depth at which the lower unit U2 is inserted into the main body 1 of the apparatus by applying the supporting shaft Q2 of the rotating means E to the innermost part of this concave portion 15*e* when the lower unit U2 is completely inserted into the main body 1 of the apparatus as shown in FIG. 3.

Figure 6A:
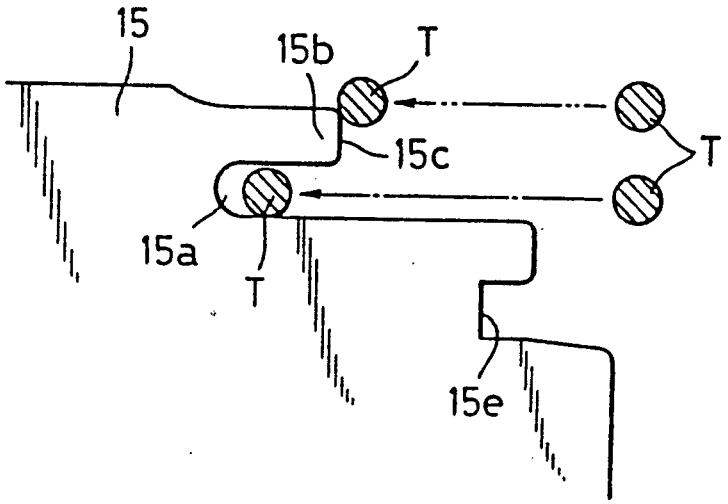
FIG. 6 (*a*) is a schematic diagram for explaining the functions of an engaging portion and a portion to be engaged in the embodiment shown in FIG. 1.
Figure 6B:
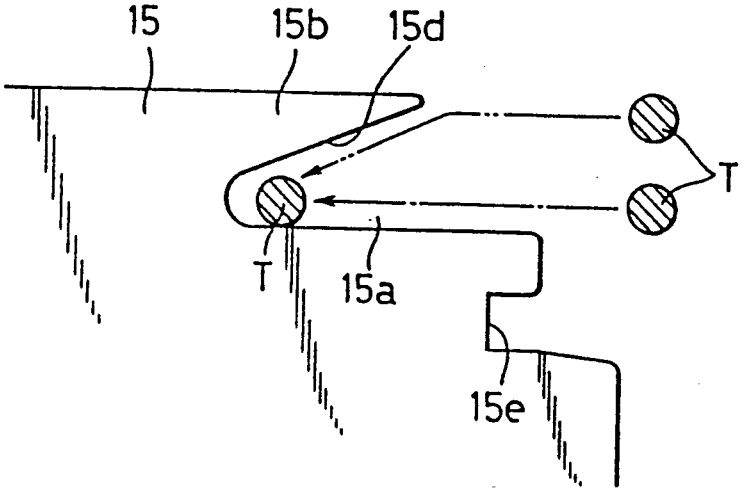

If the lower unit U2 is inserted into the main body 1 of the apparatus with the upper unit U1 being completely locked, the above projection T is introduced into the concave portion 15*a*, as represented by a dot and dash line in FIG. 6(*a*). In addition, the supporting shaft Q2 is applied to the innermost part of the concave portion 15*e*, to regulate the depth at which the lower unit U2 is inserted into the main body 1 of the apparatus. Accordingly, the lower unit U2 is positioned in the main body 1 of the apparatus. Therefore, as shown in FIG. 3, driving means D as described later is connected to a gearing G comprising gears G1 and G2 and the socket C1 and the plug C2 in the connector C are connected to each other, resulting in an operational state.

On the other hand, in a state where the upper unit U1 is not rotated to the position where it is to be locked by the locking means R, that is, a state where one side of the upper unit U1 where locking is imperfect is spaced apart from the lower unit U2, the projection T provided on the side of the upper unit U1 where locking is imperfect abuts on the stopper surface 15*c*, as represented by a two dots and dash line in FIG. 6(*a*). Consequently, the lower unit U2 is prevented from being inserted into the main body 1 of the apparatus, thereby previously preventing damage to the connector C or the like.

Meanwhile, the driving means D comprises an auxiliary motor D2, a gearing D3 driven by this auxiliary motor D2, and a gear D5 engaged to the gearing D3, as shown in FIG. 1. The auxiliary motor D2 and the gearing D3 in this driving means D are attached to a fixed plate D1 which is fixed to the main body 1 of the apparatus. In addition, the gear D5 is attached to a movable plate D4 shakably connected to the above fixed plate D1 through a supporting shaft Q4. The movable plate D4 is always pressed by a spring member D6 in the clockwise direction in FIG. 1. In the above driving means D, the above gear D5 is engaged to the gear G1 in the gearing G as shown in FIG. 3 when the unit U is inserted into the main body 1 of the apparatus. Consequently, the driving means D and the gearing G are engaged to each other. The heating roller 51 is rotated at predetermined speed by a driving source (not shown), which is connected to the above gearing D3, of the main body at the time of a fixing operation, while being rotated at low speed by the above auxiliary motor D2 at the time other than the fixing operation.

Figure 2:
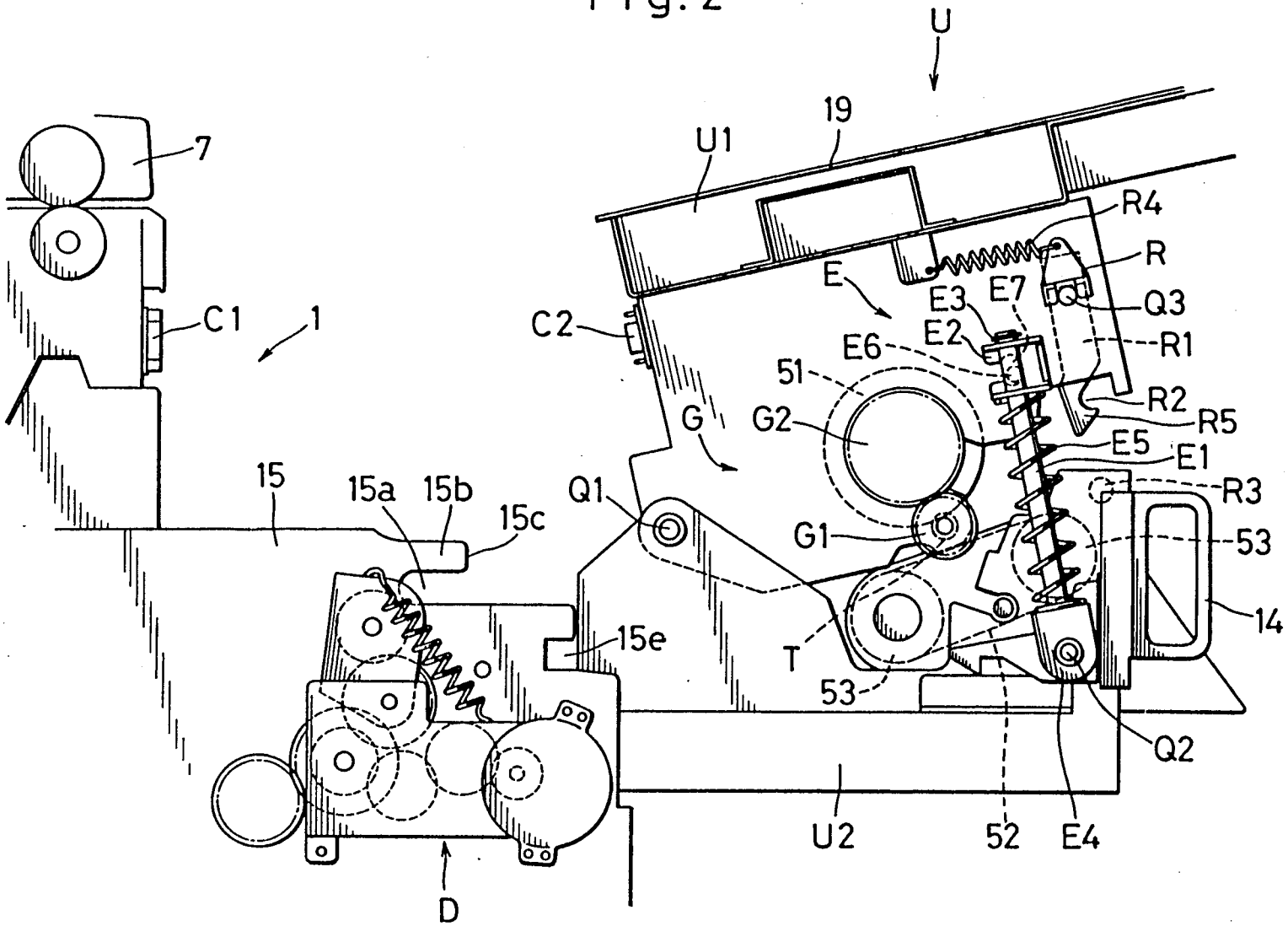
FIG. 2 is a front view showing a state where the upper unit is rotated by a constant amount by rotating means.
Figure 4:
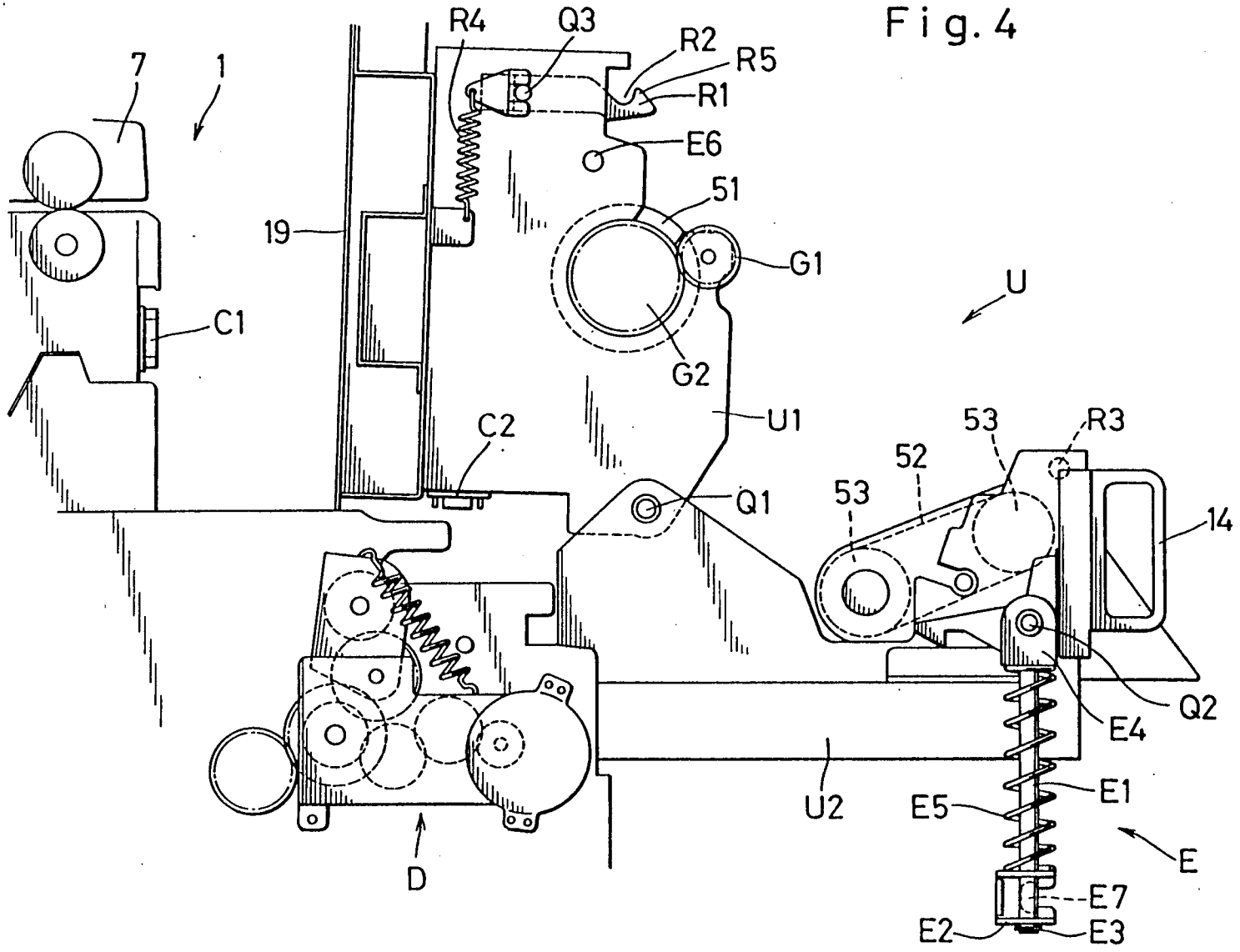
FIG. 4 is a front view showing a state where the engagement of the rotating means with the upper unit is released to rotate the upper unit to the utmost.

In a case where the upper unit U1 is in the position where it is rotated by the rotating means E as shown in FIG. 2, if the engagement of the engaging concave portion E7 in the slider E2 with the engaging pin E6 in the upper unit U1 is released, the upper unit U1 can be manually rotated to a stable state where it is completely opened as shown in FIG. 4. Accordingly, maintenance of parts in the unit U, such as the heating roller 51 and the pressure belt 52, can be easily carried out.

Figure 5:
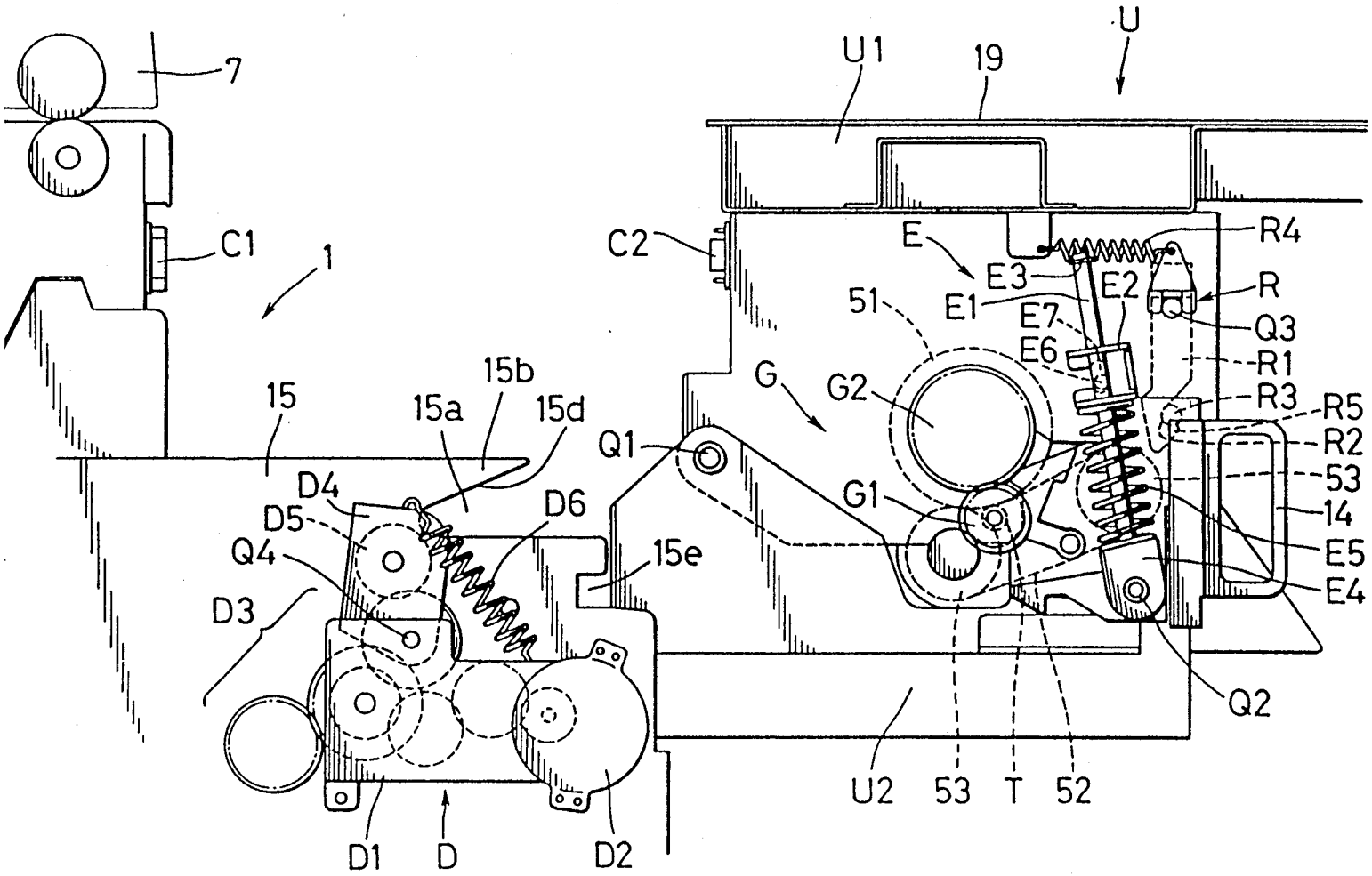
FIG. 5 is a front view showing a state where both upper and lower units in another embodiment are pulled out of the main body of the apparatus.

Description is now made of an image forming apparatus according to another embodiment of the present invention with reference to FIG. 5.

This embodiment is the same as the foregoing embodiment except that an inclined portion 15*d* serving as a portion to be engaged which is inclined downward from the end of a convex portion 15*b* to the base end thereof is formed in the lower edge of the convex portion 15*b* in place of the above described stopper surface 15*c*.

When a lower unit U2 is inserted into the main body 1 of the apparatus with an upper unit U1 being completely locked by the locking means R, a projection T as described above is introduced into a concave portion 15*a*, as represented by a dot and dash line in FIG. 6(*b*). A supporting shaft Q2 is applied to the innermost part of a concave portion 15*e*, to regulate the depth at which the lower unit U2 is inserted into the main body 1 of the apparatus, so that the lower unit U2 is positioned in the main body 1 of the apparatus. In addition, driving means D is connected to a gearing G comprising gears G1 and G2 and a socket C1 and a plug C2 in a connector C are connected to each other, resulting in a state where the image forming apparatus is operational.

On the other hand, in a state where the upper unit U1 is not rotated to the position where it is to be locked by locking means R, that is, a state where one side of the upper unit U1 where locking is imperfect is separated from the lower unit U2, a projection T provided on the side of the lower unit U1 where locking is imperfect abuts on the inclined portion 15*d*, to be moved downward along the inclined portion 15*d* as the lower unit U2 is inserted into the main body 1 of the apparatus, as represented by a two dots and dash line in FIG. 6(*b*). Correspondingly, the upper unit U1 is rotated to the position where it is to be locked by the locking means R, to be locked. Thereafter, the supporting shaft Q2 is applied to the innermost part of the concave portion 15*e*, to regulate the depth at which the lower unit U2 is inserted into the main body 1 of the apparatus, so that the lower unit U2 is positioned in the main body 1 of the apparatus, as in the foregoing case. In addition, the driving means D is connected to the gearing G comprising the gears G1 and G2 and the socket C1 and the plug C2 in the connector C are connected to each other, resulting in a state where the image forming apparatus is operational.

As described in the foregoing, in the image forming apparatus according to the present embodiment, even in a case where the upper unit U1 is not rotated to the position where it is to be locked by the locking means R, the upper unit U1 is automatically rotated to the position where it is to be locked by the locking means R as the lower unit U2 is inserted into the main body 1 of the apparatus by the engagement of the above projections T with the inclined portion 15*d*, thereby preventing damage to the connector C or the like.

It should be noted that the image forming apparatus according to the present invention is not limited to the above described two embodiments. Various modifications in design can be made without departing from the gist of the present invention.

For example, as a pressure member, a pressure roller can be used in place of the pressure belt. In addition, as a heating member, a heating belt can be used in place of the heating roller.

Although in the rotating means E according to the present embodiment, the coil spring E5 serving as an elastic member and the stopper E3 for regulating the slide of the slider E2 are arranged on the same guide shaft E1, the elastic member and a member for regulating the amount of rotation may be independently arranged each other.

As the elastic member, the coil spring can be replaced with a spring member having another shape, such as a torsion coil spring or a damper having gas in its cylinder.

The engaging portion and the portion to be engaged in the embodiment shown in FIG. 1 may comprise the projections T on the side of the upper unit and the stopper surface 15*c* on the side of the main body of the apparatus, or vice versa. In addition, the above engaging portion and the above portion to be engaged may comprise ones other than the projections and the stopper surface.

Similarly, the engaging portion and the portion to be engaged in the embodiment shown in FIG. 5 may comprise the projections T and the inclined portion 15*d*, or vice versa. In addition, the engaging portion and the portion to be engaged may comprise ones other than the projections and the inclined portion.

Furthermore, the present invention can be applied to various image forming apparatuses comprising fixing means for pressing into a heating member a paper sheet to which a toner image is transferred by a pressure member to fix the above toner image on the paper sheet, such as a facsimile and a printer, in addition to the above described electrophotographic copying apparatus.

What is claimed is:

1. An image forming apparatus, comprising:

a fixing means including a heating member and a pressure member brought into contact with the heating member for fixing a toner image transferred to a surface of a paper sheet by inserting the paper sheet therebetween;

a lower unit provided such that said lower unit can be pulled out from a main body of the image forming apparatus, said lower unit including a pressure member located in said fixing means;

an upper unit rotatably attached to said lower unit and including a heating member located in said fixing means;

a locking means for preventing rotation of the upper unit so as to maintain a state wherein said heating member and said pressure member are in contact with each other; and rotating means for slightly rotating the upper unit when said locking means is released, to release the heating member with the pressure member, wherein the rotating means includes a guide shaft turnably supported with the lower unit at one end portion thereof so as to turn around the one end portion, a slider slidably fitted on the guide shaft and detachably engaged with the upper unit, and a coil spring arranged between the one end portion of the guide shaft and the slider for pressing the slider in such a direction as to be separated from the one end portion of the guide shaft.

2. The image forming apparatus according to claim 1, wherein the slider is engaged with the upper unit by engaging an engaging concave portion provided in the slider with an engaging pin provided in the upper unit.

3. The image forming apparatus according to claim 1, wherein the main body of the apparatus is provided with a concave portion which is engaged with a supporting shaft of the guide shaft in the rotating means when the lower unit is inserted into the main body of the apparatus, to regulate a depth at which the lower unit is inserted into the main body of the apparatus.

4. An image forming apparatus, comprising:

a fixing means including a heating member and a pressure member brought into contact with the heating member for fixing a toner image transferred to a surface of a paper sheet by inserting the paper sheet therebetween;

a lower unit provided such that said lower unit can be pulled out from a main body of the image forming apparatus, said lower unit including a pressure member located in said fixing means;

an upper unit rotatably attached to said lower unit and including a heating member located in said fixing means;

a locking means for preventing rotation of the upper unit so as to maintain a state wherein said heating member and said pressure member are in contact with each other; and rotating means for slightly rotating the upper unit when said locking means is released, to release the contact of the heating member from the pressure member, wherein the locking means comprises an engaging pin provided in the lower unit, a locking plate shakably supported by the upper unit and having an engaging concave portion which is engaged with said engaging pin formed in its end, and a spring member for pressing in a direction of the engaging pin and the locking plate in which the engaging pin is engaged with the engaging concave portion.

5. An image forming apparatus, comprising:

a fixing means including a heating member and a pressure member brought into contact with the heating member for fixing a toner image transferred to a surface of a paper sheet by inserting the paper sheet therebetween;

a lower unit provided such that said lower unit can be pulled out from a main body of the image forming apparatus, said lower unit including a pressure member located in said fixing means;

an upper unit rotatably attached to said lower unit and including a heating member located in said fixing means;

a locking means for preventing rotation of the upper unit so as to maintain a state wherein said heating member and said pressure member are in contact with each other; and rotating means for slightly rotating the upper unit when said locking means is released, to release the contact of the heating member from the pressure member, wherein the main body of the apparatus and the upper unit are provided with an engaging portion and a portion to be engaged, which are engaged with each other when the lower unit is inserted into the main body of the apparatus with the upper unit not being rotated to a position where it is to be locked by the locking means, to prevent the lower unit from being inserted into the main body of the apparatus.

6. The image forming apparatus according to claim 5, wherein the engaging portion includes projections provided in the upper unit, and the portion to be engaged comprises a stopper surface formed in a side plate, of the main body of the apparatus, provided along a moving path of the lower unit and abutting on said projections.

7. The image forming apparatus according to claim 6, wherein a concave portion into which the projections are introduced when the contact of the heating member with the pressure member is perfect, to allow the lower unit to be inserted into the main body of the apparatus, said concave portion being provided in a lower part of the stopper surface.

8. The image forming apparatus according to claim 6, wherein the projections also serve as a supporting shaft of a gear for transmitting the rotation driving force to the heating member from driving means in the main body of the apparatus.

9. An image forming apparatus, comprising:

a fixing means including a heating member and a pressure member brought into contact with the heating member for fixing a toner image transferred to a surface of a paper sheet by inserting the paper sheet therebetween;

a lower unit provided such that said lower unit can be pulled out from a main body of the image forming apparatus, said lower unit including a pressure member located in said fixing means;

an upper unit rotatably attached to said lower unit and including a heating member located in said fixing means;

a locking means for preventing rotation of the upper unit so as to maintain a state wherein said heating member and said pressure member are in contact with each other; and rotating means for slightly rotating the upper unit when said locking means is released, to release the contact of the heating member from the pressure member, wherein the main body of the apparatus and the upper unit are provided with an engaging portion and a portion to be engaged, which are engaged with each other when the lower unit is inserted into the main body of the apparatus with the upper unit not being rotated to a position where it is to be locked by the locking means.

10. The image forming apparatus according to claim 9, wherein the engaging portion includes projections provided in the upper unit, and the portion to be engaged comprises an inclined portion formed in a side plate, of the main body of the apparatus, provided along a moving path of the lower unit for moving said projections downward as the lower unit is inserted into the main body of the apparatus to rotate the upper unit to the position where it is to be locked.

11. The image forming apparatus according to claim 10, wherein the projections also serve as a supporting shaft of a gear for transmitting the rotation driving force to the heating member from a driving means in the main body of the apparatus.

* * * * *